US009247356B2

(12) United States Patent
Solum et al.

(10) Patent No.: US 9,247,356 B2
(45) Date of Patent: Jan. 26, 2016

(54) MUSIC PLAYER WATCH WITH HEARING AID REMOTE CONTROL

(71) Applicant: Starkey Laboratories, Inc., Eden Prairie, MN (US)

(72) Inventors: Jeffrey Paul Solum, Shorewood, MN (US); Richard Von Lehe, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/958,102

(22) Filed: Aug. 2, 2013

(65) Prior Publication Data

US 2015/0036853 A1 Feb. 5, 2015

(51) Int. Cl.
*H04R 25/00* (2006.01)

(52) U.S. Cl.
CPC ..... *H04R 25/558* (2013.01); *H04R 25/554* (2013.01)

(58) Field of Classification Search
CPC ... H04R 25/554; H04R 25/558; H04R 222/55
USPC ..... 381/312–331
See application file for complete search history.

(56) References Cited

U.S. PATENT DOCUMENTS

| | | | | |
|---|---|---|---|---|
| 4,947,432 | A * | 8/1990 | Topholm | 381/315 |
| 6,816,600 | B1 | 11/2004 | Jakob et al. | |
| 7,136,007 | B2 | 11/2006 | Wagner | |
| 2001/0003542 | A1 * | 6/2001 | Kita | 381/334 |
| 2006/0139320 | A1 * | 6/2006 | Lang | 345/156 |
| 2008/0049957 | A1 * | 2/2008 | Topholm | 381/315 |
| 2011/0249841 | A1 * | 10/2011 | Corti et al. | 381/315 |
| 2012/0128187 | A1 * | 5/2012 | Yamada et al. | 381/313 |
| 2013/0202137 | A1 * | 8/2013 | Edgar | 381/315 |

* cited by examiner

*Primary Examiner* — Matthew Eason
(74) *Attorney, Agent, or Firm* — Schwegman, Lundberg & Woesnner, P.A.

(57) ABSTRACT

Described herein are devices and methods for enabling a hearing aid user to control the operation of the hearing aid and also select an audio source for streaming audio information such as music directly to the hearing aid. In one embodiment, these functionalities are combined into a single wrist-worn remote device that may also function as a watch.

22 Claims, 3 Drawing Sheets

MUSIC PLAYER WATCH WITH HEARING AID REMOTE CONTROL

FIELD OF THE INVENTION

This invention pertains to devices and methods for treating hearing disorders and, in particular, to electronic hearing aids.

BACKGROUND

Hearing aids are electronic instruments worn in or around the ear that compensate for hearing losses by amplifying sound. Hearing aids are capable of operating in a number of different modes which affect how the sound is delivered to the patient, where a mode is defined by a set of operating parameters. Depending upon the environment and situation, a patient may prefer one set of operating parameters over another. Hearing aids are also capable of delivering sound originating from sources other than the environment, such as from a music player or other audio device.

DETAILED DESCRIPTION

Figure 1:
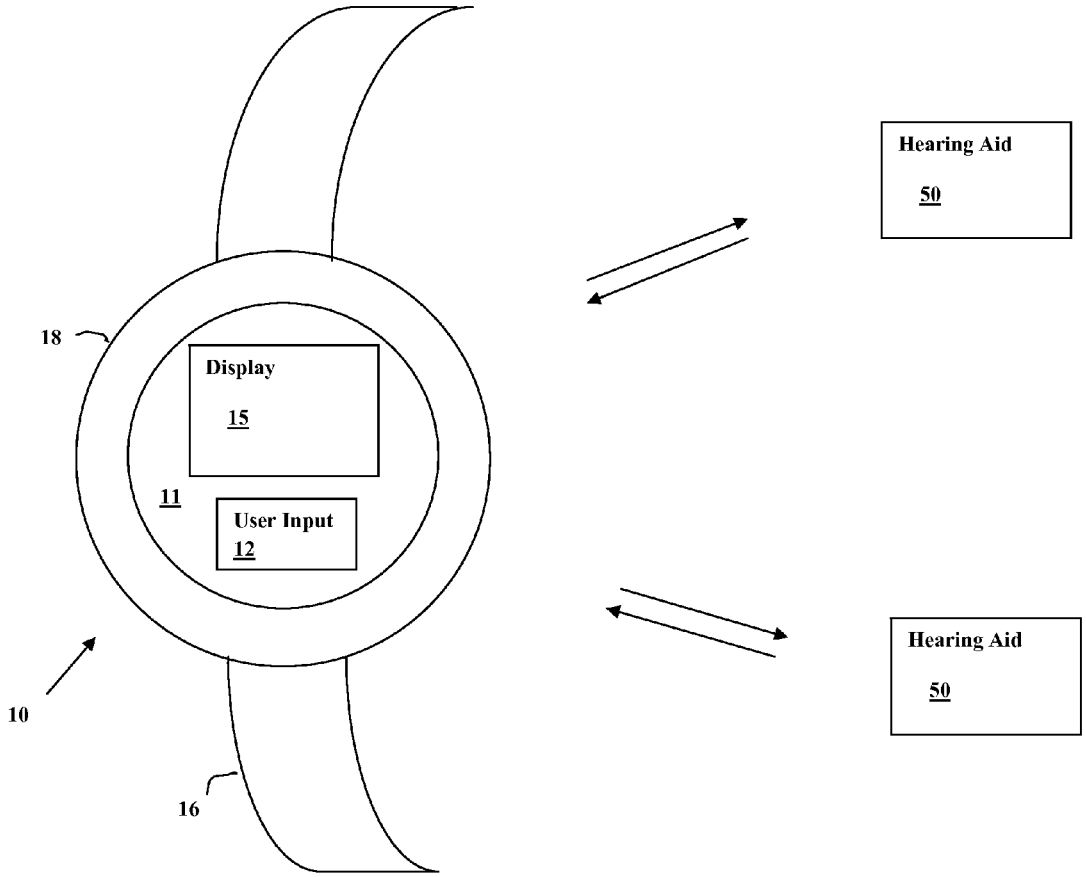
FIG. 1 shows an example remote device in the form of a wrist-worn watch communicating with a hearing aid or hearing aids.

Described herein are devices and methods for enabling a hearing aid user to control the operation of the hearing aid and also select an audio source for streaming audio information such as music directly to the hearing aid. In one embodiment, these functionalities are combined into a single wrist-worn remote device that may also function as a watch. Such a multi-function device frees the patient from carrying a separate time piece, remote control and music player. The remote device may communicate wirelessly with one or more hearing aids by means of radio transceivers incorporated into the remote device and the hearing aids. The remote device may be equipped with a digital storage device for storing audio information such as music that a user may select for streaming to the hearing aid or hearing aids. In one embodiment, the remote device is equipped with an accelerometer interfaced to the processing circuitry and wherein the processing circuitry is configured so that arm, hand, or wrist movements of a wearer of the remote device result in selected audio information or operating parameters being transmitted to the hearing aid.

In one embodiment, a hearing aid wireless remote control is a wrist-worn watch-type device with audio streaming capability for the purpose of streaming recorded audio or live audio wirelessly to a hearing aid. The device may include the ability to tell time and date, remotely control two or more hearing aids, play back recorded music such as digital audio files, play back audio from an internal or external microphone or audio input jack, and/or play live music or other audio information from a radio or internet radio contained within the watch. The watch may include an AM or FM radio (digital or analog type) as well as a WiFi or Bluetooth connections to the internet for the purpose of streaming internet radio or other audio available from the internet. The watch-type remote device may include a rotating bezel for the purpose of selecting an audio source or for selecting music from a stored library of MP3 or other digital music files contained within the device. The watch-type device may also be equipped with buttons for the purpose of controlling such functions as playback, volume, and program selection. When the remote device communicates with two hearing aids worn in opposite ears, the controls may be set up as binaural in which the user can select the side (left, right, or both) that they choose to control. In another embodiment, the watch-type device may have a touch screen digital display for the purpose of altering the functions via "soft keys" on the face of the watch.

In another embodiment the watch worn device may have Bluetooth capability for streaming audio from other Bluetooth devices and to and from cell phone type devices for the purpose of maintaining two way communication with a hearing aid. The remote device may also contain an accelerometer for the purpose of controlling hearing aid operation with hand movements. Controls such as volume and program could be implemented by moving the hand upward or downward and back and forth. The accelerometer position sensor could also allow the patient to control various gains, compression levels, and other operating parameters of the hearing instrument with hand movements.

The remote device may also be configured to receive information from the hearing aid(s) such as diagnostic data, battery level, volume setting, and memory settings and display the information to the wearer on the watch display. This gives the wearer a visual indication of the health, mode, and condition of the hearing aid(s). In another embodiment, rather than a wrist-worn device, the remote device may take the form of another type of wearable article such as a device that is worn in a pocket, worn around the neck, or attached to a user's apparel.

FIG. 1 shows one embodiment of a remote device 10 in the form of a wrist-worn device that communicates with hearing aids 50 via wireless links provided by radio transceivers in each of the devices. The device 10 comprises a housing 11 attached to straps 16 that may be wrapped around a user's wrist. The housing 11 contains processing circuitry and a radio transceiver. The processing circuitry is interfaced to a display 15 on the face of the housing 11 for displaying information to the user. A user input 12 is also provided on the face of housing and interfaced to the processing circuitry for receiving user commands. The user input may be, for example, one or more buttons.

Figure 2:
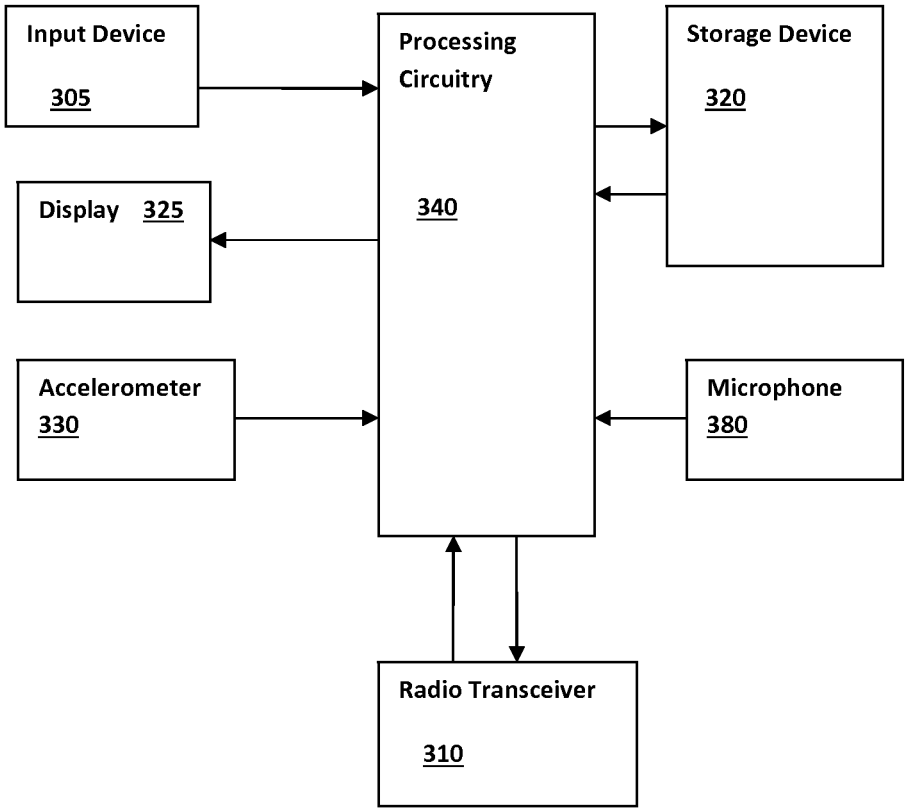
FIG. 2 is a block diagram of the components of an example remote device.

FIG. 2 illustrates the components of an example remote device that may be contained within the housing 11 of the embodiment shown in FIG. 1. Processing circuitry 340 may include a processor and associated memory and is interfaced to a radio transceiver 310. The processing circuitry is interfaced to a user input device 305 for receiving commands from the user such as selection of audio information to be transmitted to the hearing aid, hearing aid status inquiries, and hearing aid parameter setting command. A display 325 is interfaced to the processing circuitry for displaying information relating to the operation of the remote device and/or hearing aid. The processing circuitry is also interfaced to a storage device 320 that may be used to store digital audio files that may be selectively transmitted to the hearing aid for playback. A accelerometer 330 is connected to the processing circuitry for receiving user input in the form of, for example, hand, wrist, or arm movements. The remote device may also incorporate an internal or external microphone shown as microphone 380 interfaced to the processing circuitry 340. In one embodiment, microphone 380 is a directional microphone. In one embodiment, microphone 380 is a detachable external microphone (e.g., a wireless microphone) that may detached and placed in a desired location or handed to a particular person.

Figure 3:
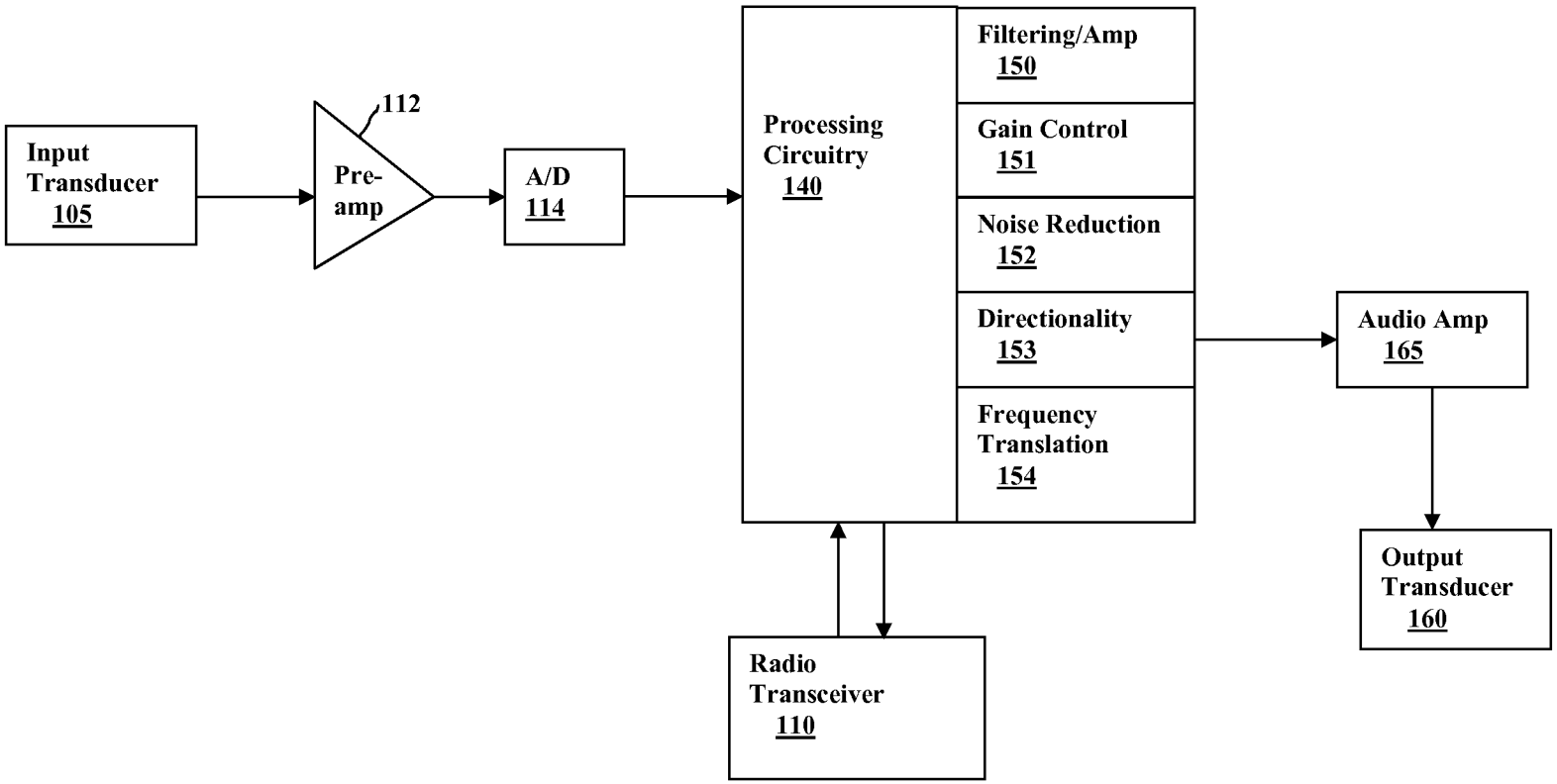
FIG. 3 is a block diagram of the components of an example hearing aid.

FIG. 3 illustrates the basic components of an example hearing aid. The electronic circuitry of a typical hearing aid is contained within a housing that is commonly either placed in the external ear canal or behind the ear. A microphone or other input transducer 105 receives sound waves from the environment and converts the sound into an input signal. After amplification by pre-amplifier 112, the input signal is sampled and digitized by A/D converter 114 to result in a digitized input signal IS. The device's signal processing circuitry 100 processes the digitized input signal IS into an output signal OS in a manner that compensates for the patient's hearing deficit. The output signal OS is then passed to an audio amplifier 165 that drives an output transducer 160 for converting the output signal into an audio output, such as a speaker within an earphone.

The signal processing circuitry 140 may include a processor and associated memory for storing executable code and data. The overall operation of the device is determined by the programming of the processing circuitry 140, which programming may be modified via a radio transceiver 110. The signal processing modules 150-154 may represent specific code executed by the controller or may represent additional hardware components. The filtering and amplifying module 150 amplifies the input signal in a frequency specific manner as defined by one or more signal processing parameters specified by the controller. The patient's hearing deficit may compensated by selectively amplifying those frequencies at which the patient has a below normal hearing threshold. Other signal processing functions may also be performed in particular embodiments. The gain control module 151 dynamically adjusts the amplification in accordance with the amplitude of the input signal. Compression, for example, is a form of automatic gain control that decreases the gain of the filtering and amplifying circuit to prevent signal distortion at high input signal levels and improves the clarity of sound perceived by the patient. Other gain control circuits may perform other functions such as controlling gain in a frequency specific manner. The noise reduction module 152 performs functions such as suppression of ambient background noise and feedback cancellation. The directionality module 153 weights and sums the output signals of multiple microphones in a manner that preferentially amplifies sound emanating from a particular direction (e.g., from in front of the patient). The frequency translation module 154 maps parts of the input sound signal or features extracted from the input sound signal from one frequency band to another. The processing circuitry specifies one or more signal processing parameters to the filtering and amplifying module and/or other signal processing modules that determine the manner in which the input signal IS is converted into the output signal OS. The one or more signal processing parameters that define a particular mode of operation may be referred to as a signal processing parameter set.

The radio transceiver 110 allows user input of data to a parameter modifying area of the processing circuitry memory so that parameters affecting device operation may be changed as well as retrieval of those parameters. The radio transceiver 110 may communicate with a variety of devices such as an external programmer. The radio transceiver also provides a wireless link to a remote device as described above and may be used to receive audio information from the remote device for conversion into an input signal that may be further processed to produce sound to the user. The radio transceiver may also be used to transmit information to the remote device such as such as battery level and current operating parameters.

In certain embodiments, the processing circuitry 340 of the remote device is configured to perform hearing loss compensation processing on audio signals prior to their being transmitted to the hearing aid for playback. That is, some or all of the hearing loss compensation processing normally performed by signal processing modules 151-154 of the hearing aid illustrated in FIG. 3 are instead performed by the remote device and then sent to the hearing aid so that the audio presented to the hearing aid wearer is "ready for listening" according to the wearer's particular hearing loss. In certain embodiments, the hearing aid is configured to upload hearing aid parameters specifically programmed for the hearing aid wearer for use by the processing circuitry in performing the hearing loss compensation processing. Audio such as recorded music, sound picked up by the remote device's microphone, and live streaming audio content received over a network may be preprocessed and transmitted to the hearing aid in this manner. Such offloading of the signal processing normally performed by the hearing instrument may save power and extend the battery life of the hearing aid or allow for other processing by the hearing aid's signal processor. This may be especially important when the hearing aid is playing back streaming audio transmitted by the remote device since the wireless communication link consumes significant battery power.

It is understood that variations in configurations and combinations of components may be employed without departing from the scope of the present subject matter. Hearing assistance devices typically include an enclosure or housing, a microphone, hearing assistance device electronics including processing electronics, and a speaker or receiver. The examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A system, comprising:

a hearing aid comprising an input transducer for converting sound into a input signal, processing circuitry for filtering and amplifying the input signal in accordance with specified signal processing parameters to produce an output signal, a radio transceiver interfaced to the processing circuitry, and an output transducer for converting the output signal into sound;

wherein the processing circuitry of the hearing aid is configured to receive parameter sets that modify the operation of the hearing aid via the radio transceiver and further configured to receive an audio signal via the wireless transceiver from which an input signal is generated;

a remote device comprising processing circuitry interfaced to a user input device and interfaced to a radio transceiver, wherein the processing circuitry is configured to transmit parameter sets and music to the hearing aid via the radio transceiver; and, wherein the remote device is equipped with an accelerometer interfaced to the processing circuitry and wherein the processing circuitry is configured so that arm, hand, or wrist movements of a wearer of the remote device result in selected music being transmitted to the hearing aid.

2. The system of claim 1 wherein the remote device incorporates a storage device for storing audio information and wherein the processing circuitry is configured to retrieve selected audio information from the storage device and for transmission to the hearing aid in accordance with a user command.

3. The system of claim 1 wherein the remote device is a wrist-worn device.

4. The system of claim 3 wherein the remote device incorporates a watch having timekeeping and alarm functionalities.

5. The system of claim 4 wherein the remote device is equipped with a rotating bezel for selecting from different audio sources accessible by the remote device for transmitting to the hearing aid.

6. The system of claim 4 wherein the remote device is equipped with buttons for controlling hearing aid functions and functions and or modes of the watch.

7. The system of claim 3 wherein the remote device includes a display and wherein the remote device's processing circuitry is configured to obtain status parameters from the hearing aid via the radio transceiver and display the parameters so obtained.

8. The system of claim 1 wherein the radio transceiver of the remote device is configured to receive signals from a broadcast radio station for relaying to the hearing aid.

9. The system of claim 1 wherein the remote device is configured to store and send event reminders to the hearing aid.

10. The system of claim 1 wherein the remote device processing circuitry is configured so that arm, hand, or wrist movements a wearer of the remote device changes the gain or compression settings of the hearing aid.

11. The system of claim 1 wherein the remote device processing circuitry is configured to establish and maintain two-way communication with another audio source.

12. The system of claim 1 wherein the remote device processing circuitry and radio transceiver is configured to communicate with WiFi or Bluetooth enabled devices.

13. The system of claim 1 wherein the remote device is adapted for attaching to a user's apparel.

14. The system of claim 1 wherein the remote device is adapted for wearing around a user's neck.

15. A wrist-worn device, comprising:

a housing with a strap for wearing around a user's wrist;

processing circuitry and a radio transceiver contained within the housing;

wherein the processing circuitry is configured to receive user inputs and display information on a face of the housing;

wherein the processing circuitry is configured to transmit parameter sets and music to a hearing aid via the radio transceiver; and, wherein the wrist-worn device is equipped with an accelerometer interfaced to the processing circuitry and wherein the processing circuitry is configured so that arm, hand, or wrist movements of a wearer of the wrist-worn device result in selected music being transmitted to the hearing aid.

16. The device of claim 15 wherein the remote device incorporates a storage device for storing audio information and wherein the processing circuitry is configured to retrieve selected audio information from the storage device and for transmission to the hearing aid in accordance with a user command.

17. The device of claim 15 wherein the processing circuitry is configured to perform timekeeping and alarm functionalities.

18. The device of claim 15 further comprising a rotating bezel interfaced to the processing circuitry for selecting from different audio sources for transmitting to the hearing aid.

19. The device of claim 17 further comprising buttons for controlling hearing aid functions or timekeeping functions.

20. The device of claim 15 wherein the processing circuitry is configured to obtain status parameters from the hearing aid via the radio transceiver and display the parameters so obtained.

21. The system of claim 1 wherein the processing circuitry of the remote device is configured to perform hearing loss compensation processing on the audio signal prior to transmitting the audio signal to the hearing aid.

22. The device of claim 15 wherein the processing circuitry of the device is configured to perform hearing loss compensation processing on the audio signal prior to transmitting the audio signal to the hearing aid.

* * * * *